US010485716B2

(12) United States Patent
Yang et al.

(10) Patent No.: US 10,485,716 B2
(45) Date of Patent: Nov. 26, 2019

(54) LOADING TRANSFER DEVICE

(71) Applicant: iMobilities Inc., Huwei Township, Yunlin County (TW)

(72) Inventors: Hsiao-Min Yang, Huwei Township, Yunlin County (TW); Yan-Zhang Chen, Huwei Township, Yunlin County (TW)

(73) Assignee: iMobilities Inc., Huwei Township (TW)

( * ) Notice: Subject to any disclaimer, the term of this patent is extended or adjusted under 35 U.S.C. 154(b) by 0 days.

(21) Appl. No.: 15/976,609

(22) Filed: May 10, 2018

(65) Prior Publication Data

US 2018/0325756 A1 Nov. 15, 2018

Related U.S. Application Data

(60) Provisional application No. 62/503,953, filed on May 10, 2017.

(51) Int. Cl.
*A61G 3/02* (2006.01)
*A61G 3/08* (2006.01)
*A61G 3/06* (2006.01)

(52) U.S. Cl.
CPC ..... *A61G 3/0209* (2013.01); *A61G 3/062* (2013.01); *A61G 3/0808* (2013.01)

(58) Field of Classification Search
CPC ..... A61G 3/0209; A61G 3/062; A61G 3/0808
USPC ..... 224/496; 414/462, 467
See application file for complete search history.

(56) References Cited

U.S. PATENT DOCUMENTS 3,622,026 A 11/1971 Tornheim
3,627,158 A * 12/1971 Kobasic ..... B60R 5/04 414/462
3,807,592 A * 4/1974 Lynn ..... A61G 3/0209 414/462
4,073,395 A * 2/1978 Clement ..... B60R 5/04 224/548
4,236,860 A 12/1980 Gottlieb et al.
4,272,218 A 6/1981 Carter
4,299,527 A * 11/1981 Pobocik ..... A61G 3/0209 414/462
4,407,624 A 10/1983 Kingston
(Continued)

*Primary Examiner* — Nathan J Newhouse
*Assistant Examiner* — Lester L Vanterpool

(57) ABSTRACT

A loading transfer device includes: a carriage adapted for attachment to a lower surface of the rear compartment; a rack to hold the wheelchair or other object; and rotatable linkage means pivotally connecting the rack to the carriage, whereby, as the linkage means is rotated in a substantially continuous forward pivotal motion during a loading cycle, the rack and the wheelchair or other object held thereon are raised from a substantially vertically oriented loading position at the rear of the vehicle in which the rack is adjacent a ground surface rearward of the vehicle to facilitate placement of the wheelchair or other object thereonto, forwardly pivoted through approximately 90°, passing through a point of maximum elevation, and lowered and moving forward simultaneously to a substantially horizontal storage position in which the rack is adjacent and substantially parallel to the carriage in the compartment, the cycle being reversible for unloading; wherein when the rack and the chair or other object are in the storage position, the carriage, the rack and the chair can be transported by the vehicle.

13 Claims, 18 Drawing Sheets

(56) References Cited

U.S. PATENT DOCUMENTS

| | | | | | |
|---|---|---|---|---|---|
| 4,573,854 | A * | 3/1986 | McFarland | A61G 3/0209 | 224/553 |
| 4,616,972 | A * | 10/1986 | McFarland | A61G 3/0209 | 224/496 |
| 4,685,860 | A * | 8/1987 | McFarland | A61G 3/0209 | 212/280 |
| 5,096,361 | A * | 3/1992 | Crawford | A61G 3/0209 | 414/462 |
| 5,967,736 | A * | 10/1999 | Poindexter | B60R 5/04 | 414/549 |
| 10,124,852 | B2 * | 11/2018 | Potticary | B60R 11/00 | |
| 2005/0105994 | A1 * | 5/2005 | Wolfe | B60P 1/4442 | 414/540 |
| 2006/0233632 | A1 * | 10/2006 | Hayes | A61G 3/06 | 414/546 |
| 2007/0071569 | A1 * | 3/2007 | Sobota | A61G 3/06 | 410/121 |
| 2007/0183881 | A1 * | 8/2007 | O'Leary | B60P 1/4442 | 414/546 |
| 2007/0189885 | A1 * | 8/2007 | Madormo | A61G 3/0209 | 414/467 |
| 2008/0069675 | A1 * | 3/2008 | Scism | A61G 3/0209 | 414/462 |

* cited by examiner

LOADING TRANSFER DEVICE

FIELD OF THE INVENTION

This invention relates to loading transfer device for loading a wheelchair or similar object into a vehicle, and more particularly, to a loading transfer device having a storage position fully contained within the vehicle.

BACKGROUND OF THE INVENTION

U.S. Pat. No. 3,622,026 illustrates a device for tilting a load from a vertical to a horizontal position onto the flatbed of a truck utilizing two linkages that simply rotate the load about a fixed pivot point. This is distinct from the present invention, which uses a set of driving links and another set of driven links to lift, as well as rotate, the load into a substantially horizontal storage position.

U.S. Pat. Nos. 3,627,158, 3,807,592 and US Pub. No. 20080069675 indicate apparatus which could be used for loading a wheelchair by manually tilting and lifting a rack to the level of the rear compartment of a vehicle, and then sliding or rolling the apparatus into the rear compartment. None of these loaders uses a linkage or electric motor-driven power train as does the present invention. In addition, the U.S. Pat. No. 3,807,592 requires a roller to be mounted on the rear bumper of the vehicle, and thus the apparatus is not fully contained in the rear compartment.

U.S. Pat. Nos. 4,236,860 and 4,272,218 describe apparatus for externally loading a wheelchair on the vehicle roof, rather than into a limited internal space as does the present invention. U.S. Pat. No. 4,407,624 shows a wheelchair loading apparatus having a linkage comprised of five pivotal interconnected links to raise a wheelchair into a vehicle. The wheelchair is always maintained in an upright position. The present invention stores the wheelchair in a collapsed, horizontal position, thus permitting it to be stored in a much smaller space than does the apparatus disclosed in the U.S. Pat. No. 4,407,624.

U.S. Pat. Nos. 4,573,854 and 4,616,972 propose an apparatus for loading a wheelchair or similar object, having a linkage set and a carriage. Such that the linkages elevate the object and pivot it in a horizontal angle in a forward cycle. However this design needs additional sliding tracks to bring up the horizontal stroke in order to fully retract the object into the vehicle compartment and store in a forwardmost position, while the linkage mechanism in the present invention automatically generates a comparatively longer stroke, hence requiring no track on vehicle chassis US Pub. No. 20050105994 presents an inside-vehicle lift for transferring a load through a rear door opening of a vehicle. The load platform is horizontally movable between a loading position with the load platform being disposed behind a rear bumper of the vehicle and a transport position inside the vehicle. Multiple sets of actuators, the lift actuators and the horizontal sliding/rotating actuators, are required in US Pub. No. 20050105994 however the present invention needs only one/one set of actuator(s) to achieve the vertical lift motion as well as the horizontal sliding motion.

SUMMARY OF THE INVENTION

An important objective of the present invention is to provide a loading transfer device for loading and unloading an object, such as a wheelchair, from a vehicle in which the loading transfer device and the stored object may be fully contained within a rear compartment of the vehicle.

Another objective of the invention is to provide a loading transfer device for loading or unloading a wheelchair or similar object by using a reversible electrical motor so that the operation may be carried out by a handicapped person or other person lacking of muscle strength.

A further objective of the invention is to provide a wheelchair loading transfer device which is adaptable to many different kinds of vehicles and which may be adjusted to compensate for the height variations of the vehicle rear compartment above the ground surface.

Additional objectives and advantages of the invention will become apparent as the following detailed description of the preferred embodiments is read in conjunction with the accompanying drawings which illustrate such preferred embodiments.

In order to achieve one or a portion of or all of the objectives, an embodiment of the invention provides a loading transfer device. The loading transfer device includes: a carriage adapted for attachment to a lower surface of the rear compartment; a rack to hold the wheelchair or other object; and rotatable linkage means pivotally connecting the rack to the carriage, whereby, as the linkage means is rotated in a substantially continuous forward pivotal motion during a loading cycle, the rack and the wheelchair or other object held thereon are raised from a substantially vertically oriented loading position at the rear of the vehicle in which the rack is adjacent a ground surface rearward of the vehicle to facilitate placement of the wheelchair or other object thereonto, forwardly pivoted through approximately 90°, passing through a point of maximum elevation, and lowered and moving forward simultaneously to a substantially horizontal storage position in which the rack is adjacent and substantially parallel to the carriage in the compartment, the cycle being reversible for unloading; wherein when the rack and the chair or other object are in the storage position, the carriage, the rack and the chair can be transported by the vehicle.

BRIEF DESCRIPTION OF THE DRAWINGS

The present invention will become more readily apparent to those ordinarily skilled in the art after reviewing the following detailed description and accompanying drawings, in which.

DETAILED DESCRIPTION OF PREFERRED EMBODIMENTS

Figure 1:
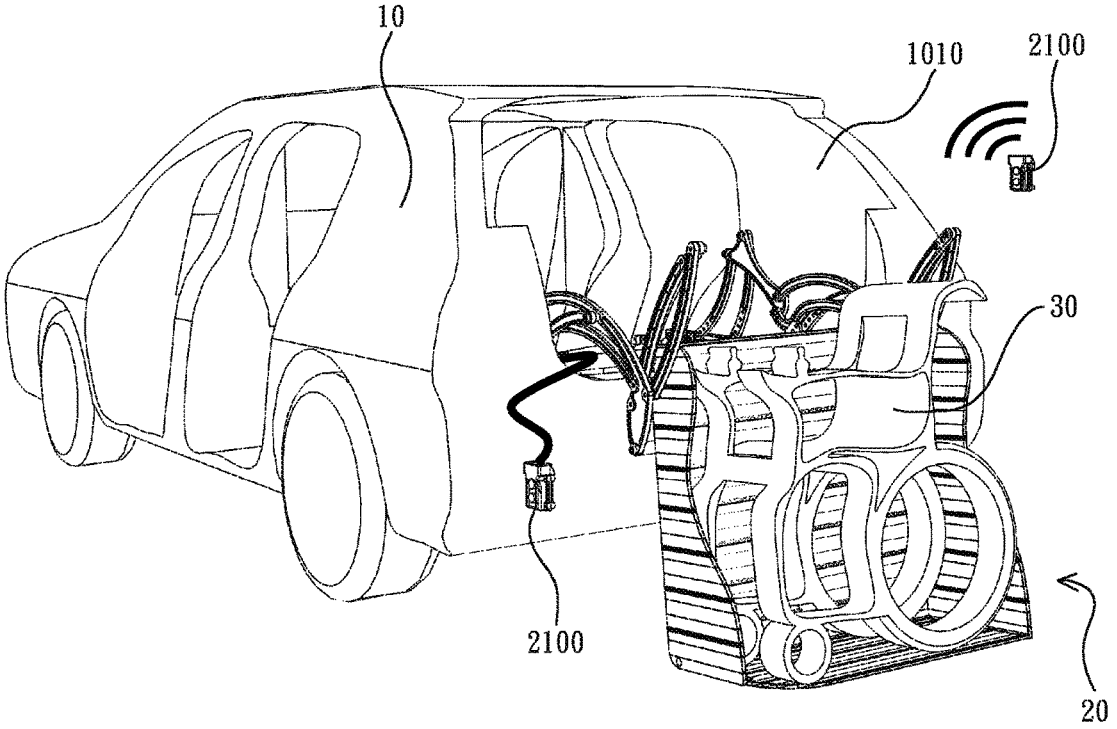
FIG. 1 is a diagram schematically showing a vehicle rear compartment equipped with a loading transfer device having a wheelchair in extracted state as a load according to an embodiment of the present invention.
Figure 2:
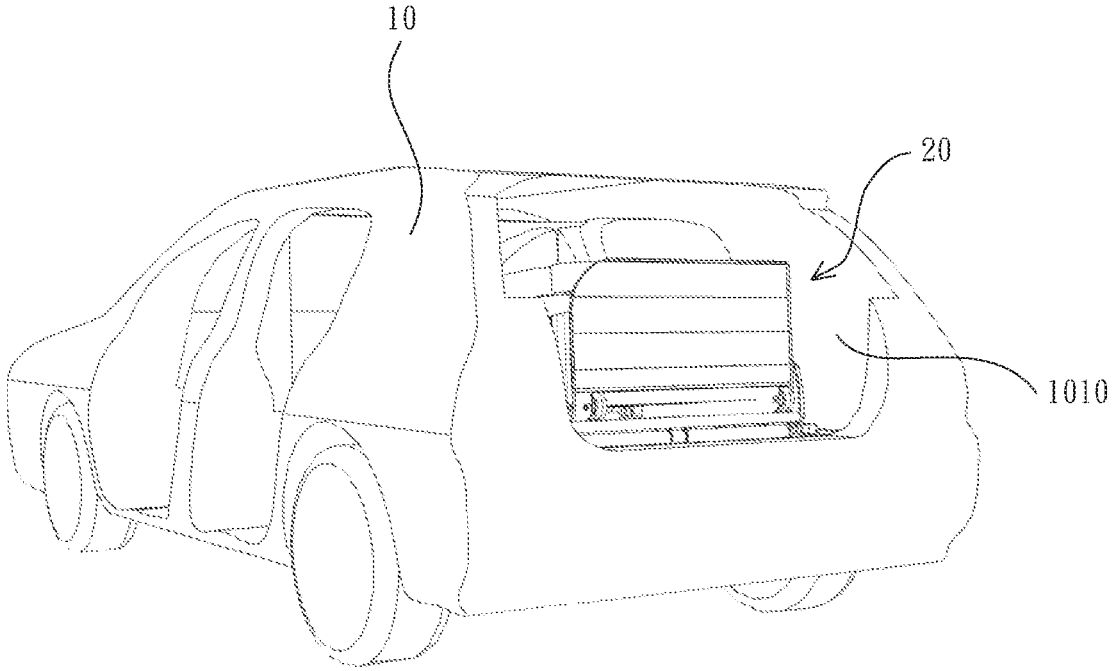
FIG. 2 is a diagram schematically showing a vehicle rear compartment equipped with a loading transfer device having a wheelchair in retracted state according to an embodiment of the present invention.

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

The present invention provides a loading transfer device for loading a wheelchair or similar object of the present invention is designed to be fully contained within a rear compartment of a vehicle. An embodiment is designed to load a wheelchair into the rear compartment of a station wagon or similar vehicle, but could also be used at a rear or side opening of a van or similar vehicle.

Referring to the drawings, and more particularly to FIGS. 1-4, the embodiment of the loading transfer device 20 of the present invention for loading a wheelchair or similar object 30 is schematically illustrated. This embodiment is well adapted for loading a wheelchair or other object 30 into the vehicle rear compartment 1010 of a station wagon or similar vehicle 10. This embodiment can also be used at a rear or side opening of a van, a sedan or similar vehicle.

Figure 3:
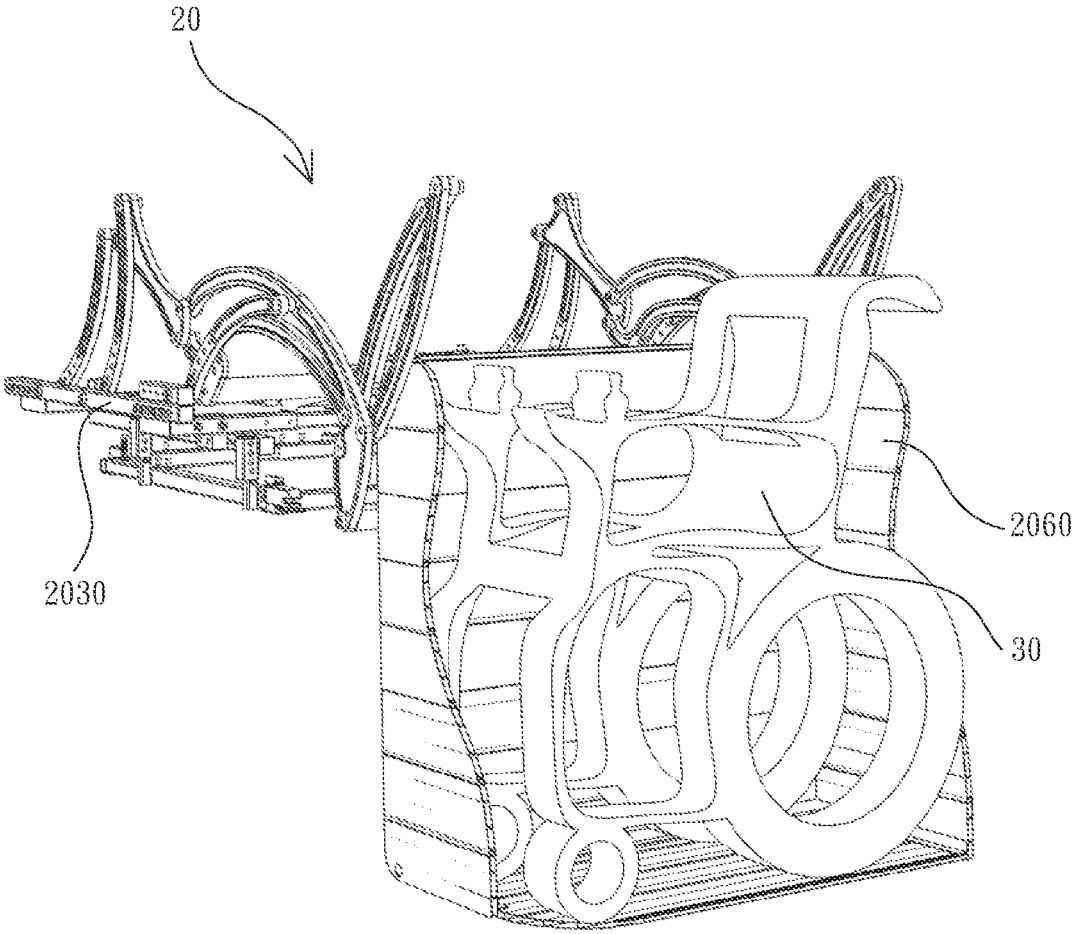
FIG. 3 is a diagram schematically showing a loading transfer device having a wheelchair in extracted state as a load according to an embodiment of the present invention.
Figure 4:
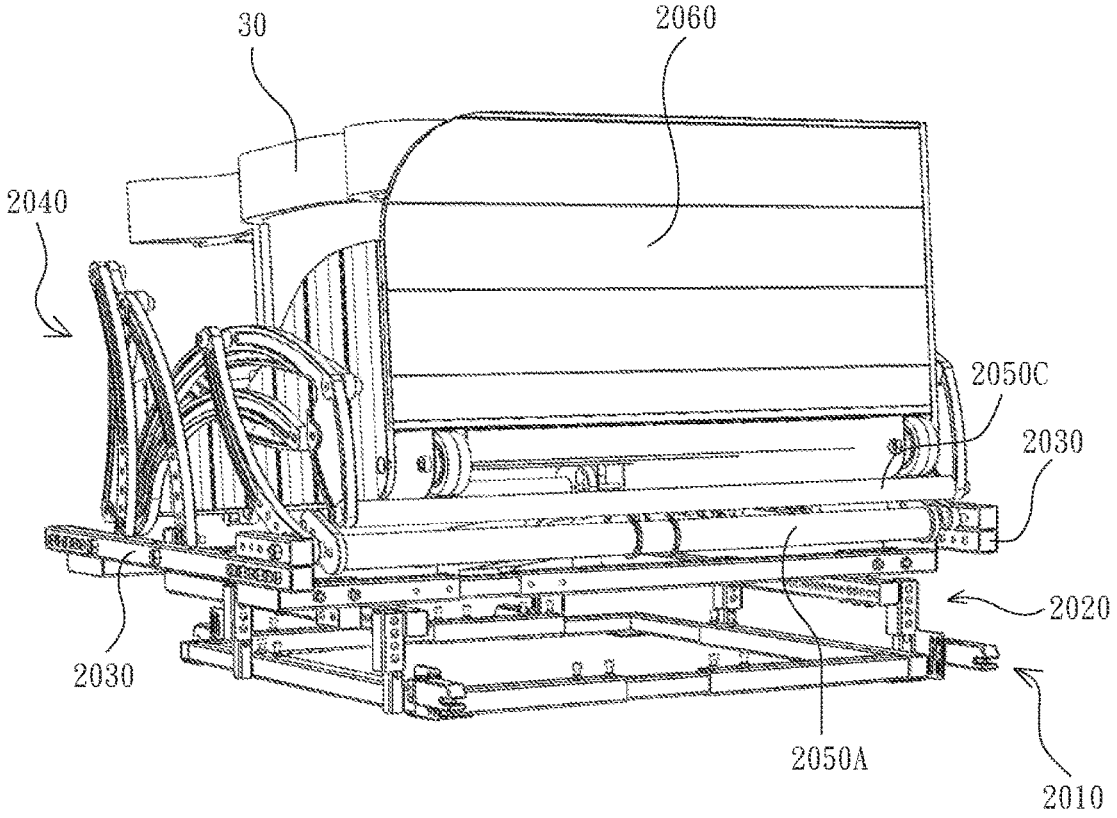
FIG. 4 is a diagram schematically showing a loading transfer device having a wheelchair in retracted state as a load according to an embodiment of the present invention.

Referring to FIGS. 1, 3, 9, 12 and 16, the loading transfer device 20 is shown in a position in which a wheelchair or other object 30 may be loaded or unloaded. In FIGS. 3 and 4, a carriage 2030 is mounted to lower surface or floor of a vehicle rear compartment 1010. In FIGS. 3 and 4, a rack 2060 is included in this invention. A set of rotatable linkage means 2040 pivotally connects the carriage 2030 to the rack 2060, whereby, as the linkage means 2040 is rotated in a substantially continuous forward pivotal motion during a loading cycle, the rack 2060 and wheelchair or other object 30 held thereon are raised from a substantially vertically oriented loading position at the rear of the vehicle 10 in which the rack 2060 is adjacent a ground surface rearward of the vehicle 10 to facilitate placement of the wheelchair or other object 30 thereonto, forwardly pivoted through approximately 90°, passing through a point of maximum elevation, and lowered and moving forward simultaneously to a substantially horizontal storage position in which the rack 2060 is adjacent and substantially parallel to the carriage 2030 in the vehicle rear compartment 1010, the cycle being reversible for unloading; wherein when the rack 2060 and the wheelchair or other object 30 are in the storage position, the carriage 2030, the rack 2060 and the wheelchair or other object 30 can be transported by the vehicle 10.

Figure 5:
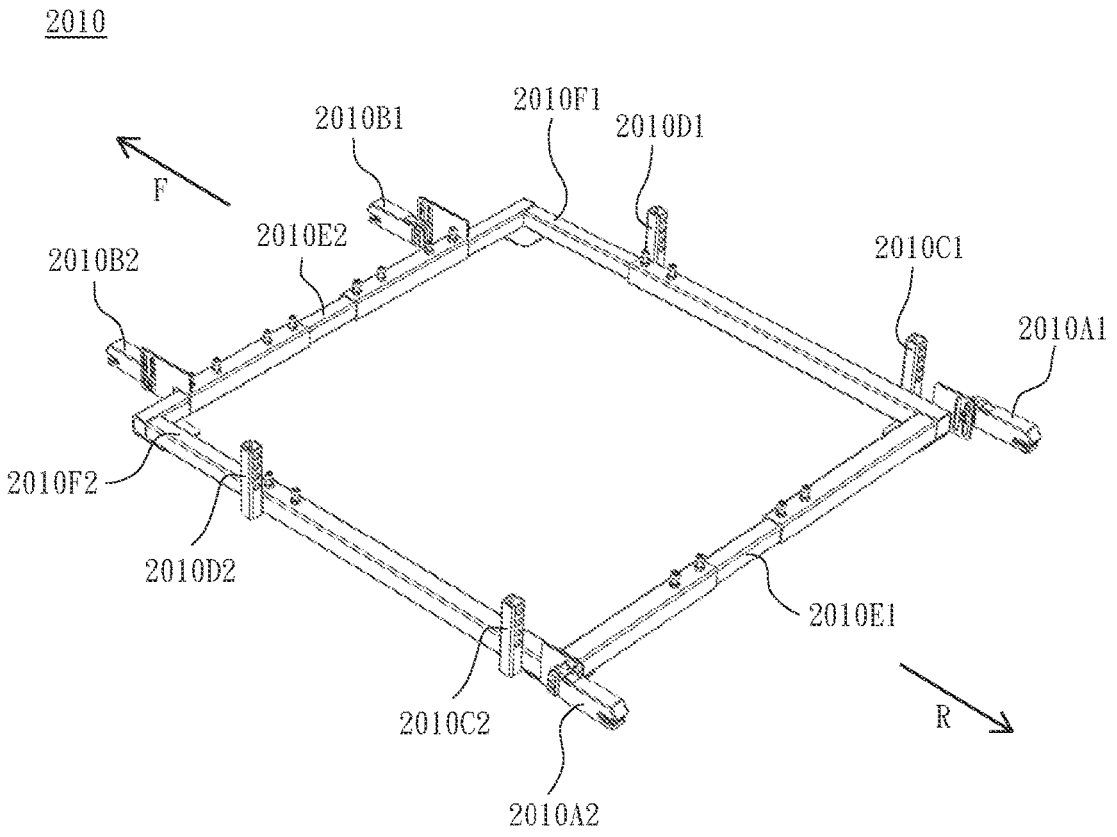
FIG. 5 is a diagram schematically showing a chassis of the loading transfer device according to an embodiment of the present invention.

Refer to FIG. 4, in order to adapt to a vehicle rear compartment 1010 of different vehicles 10, the carriage 2030 further includes a chassis 2010 and a height adaptor 2020. As shown in FIGS. 5-8*a*, the arrow F indicates the forward-side direction of the vehicle 10, and the arrow R indicates the rear-side direction of the vehicle 10. Refer to FIG. 5, the chassis 2010 has a surface to be in contact with the lower surface of the rear compartment, a set of first chassis height connector 2010C1, 2010C2 and a set of second chassis height connector 2010D1, 2010D2 which is located at the forward side of the first chassis height connector 2010C1, 2010C2 of the chassis 2010. The chassis 2010 further include a set of first chassis connector 2010A1, 2010A2, a set of second chassis connector 2010B1, 2010B2, a set of chassis width adjuster 2010E1, 2010E2, and a set of chassis depth adjuster 2010F1, 2010F2. The chassis width adjuster 2010E1 connects rear end of the chassis depth adjuster 2010F1 with rear end of the chassis depth adjuster 2010F2, and the chassis width adjuster 2010E2 connects front end of the chassis depth adjuster 2010F1 with front end of the chassis depth adjuster 2010F2. The first chassis connectors 2010A1 and 2010A2 are respectively configured on the rear ends of the chassis depth adjusters 2010F1 and 2010F2. The second chassis connector 2010B1 and 2010B2 are respectively configured on the front ends of the chassis depth adjusters 2010F1 and 2010F2.

Figure 6:
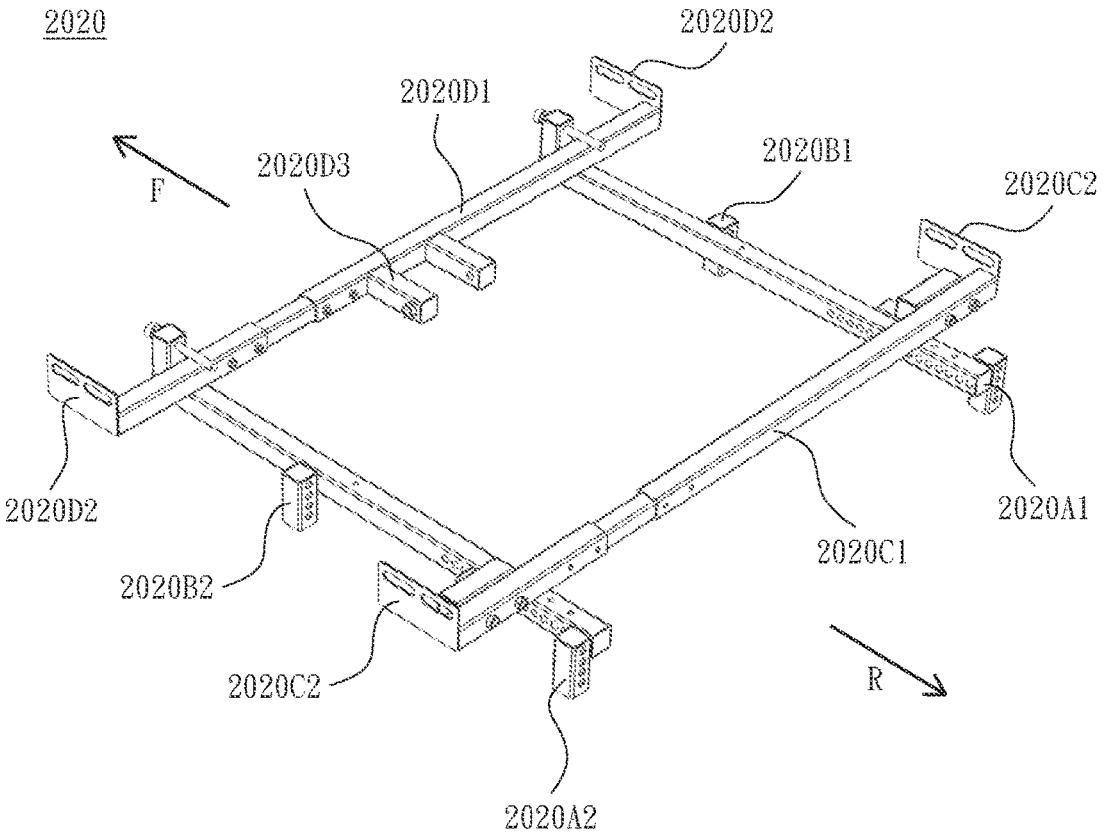
FIG. 6 is a diagram schematically showing a height adaptor of the loading transfer device according to an embodiment of the present invention.

As shown in FIG. 6, the height adaptor 2020 has a set of first adaptor height connector 2020A1, 2020A2 and a set of second adaptor height connector 2020B1, 2020B2 which is located at the forward side of the first adaptor height connector 2020A1, 2020A2 of the height adaptor 2020. The height adaptor 2020 further includes an adaptor width adjustor 2020C1, a set of adaptor depth adjusting pairs 2020C2 and 2020D2, a adaptor motor rod 2020D1, and an adaptor motor base 2020D3. The adaptor depth adjusting pair 2020C2 is respectively arranged on two opposite end of the adaptor width adjustor 2020C1. The adaptor depth adjusting pair 2020D2 are respectively arranged on two opposite end of the motor rod 2020D1. The adaptor motor base 2020D3 is connected with the motor rod 2020D1.

Figure 7:
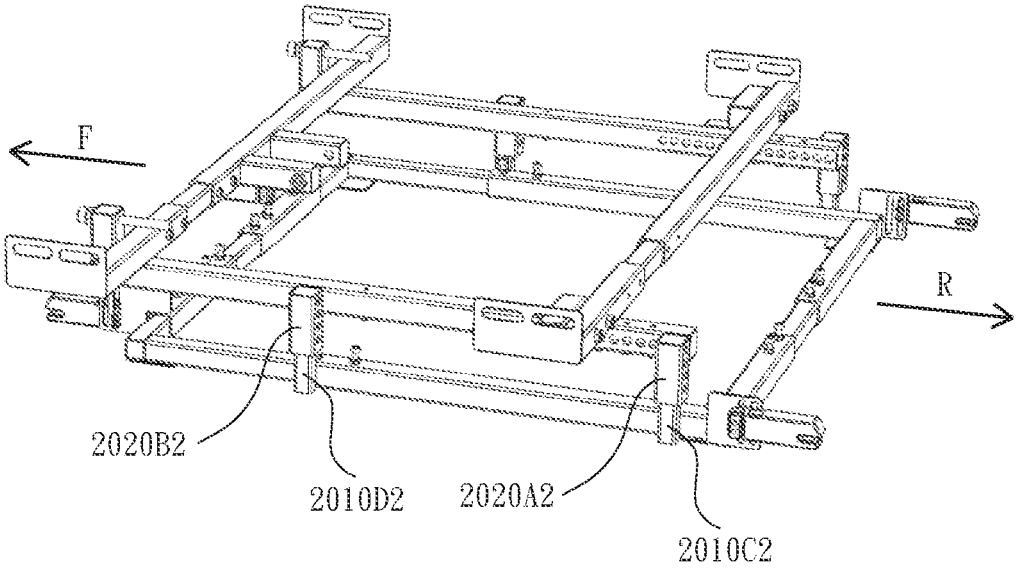
FIG. 7 is a diagram schematically showing the height adaptor assembled with the chassis according to an embodiment of the present invention.

As shown in FIG. 7, the first adaptor height connector 2020A1, 2020A2 is substantially coaxially connected to the first chassis height connector 2010C1, 2010C2, and the set of second adaptor height connector 2020B1, 2020B2 is substantially coaxially connected to the second chassis height connector 2010D1, 2020D2.

Figure 12:
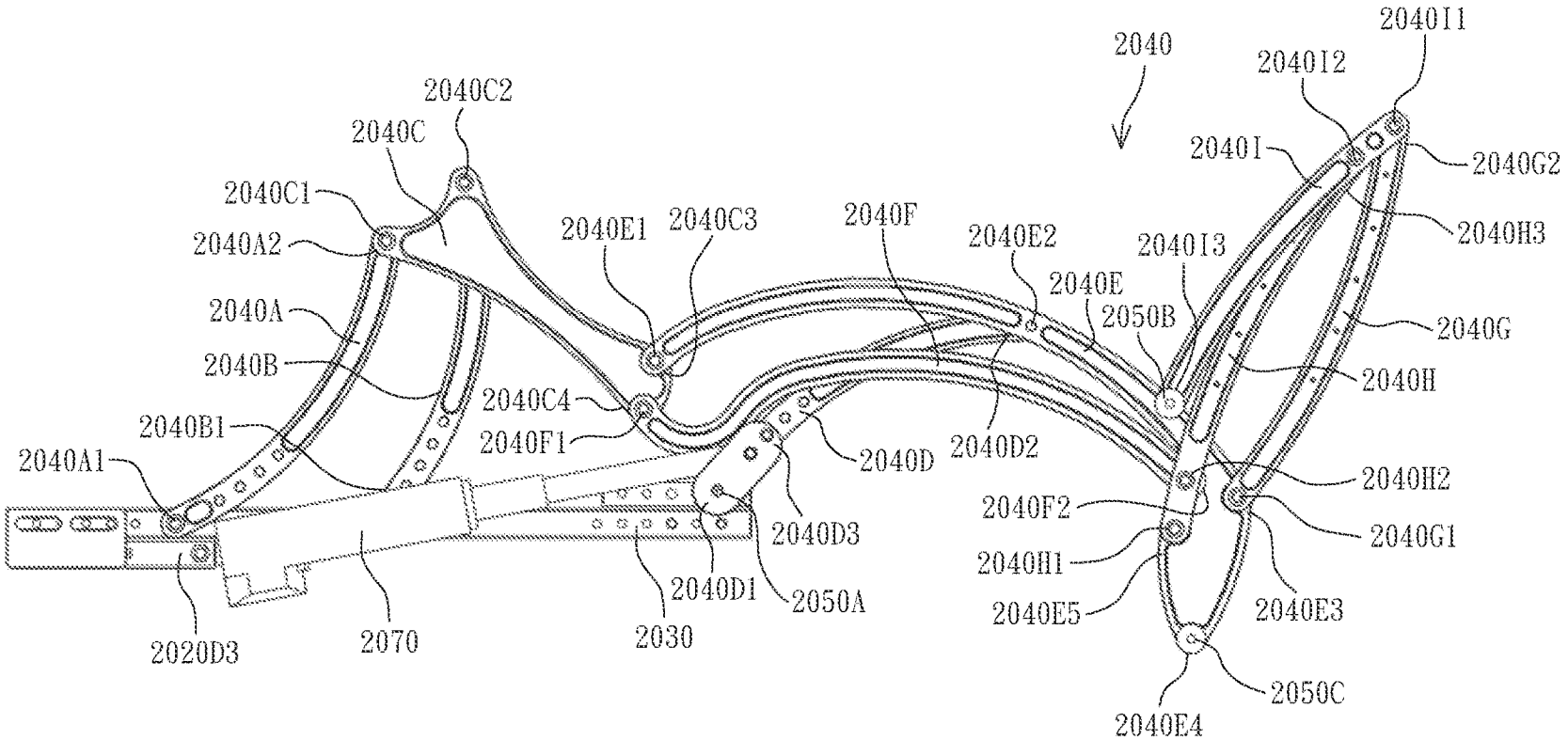
FIG. 12 is a side view of the extracted linkage means according to an embodiment of the present invention.
Figure 13:
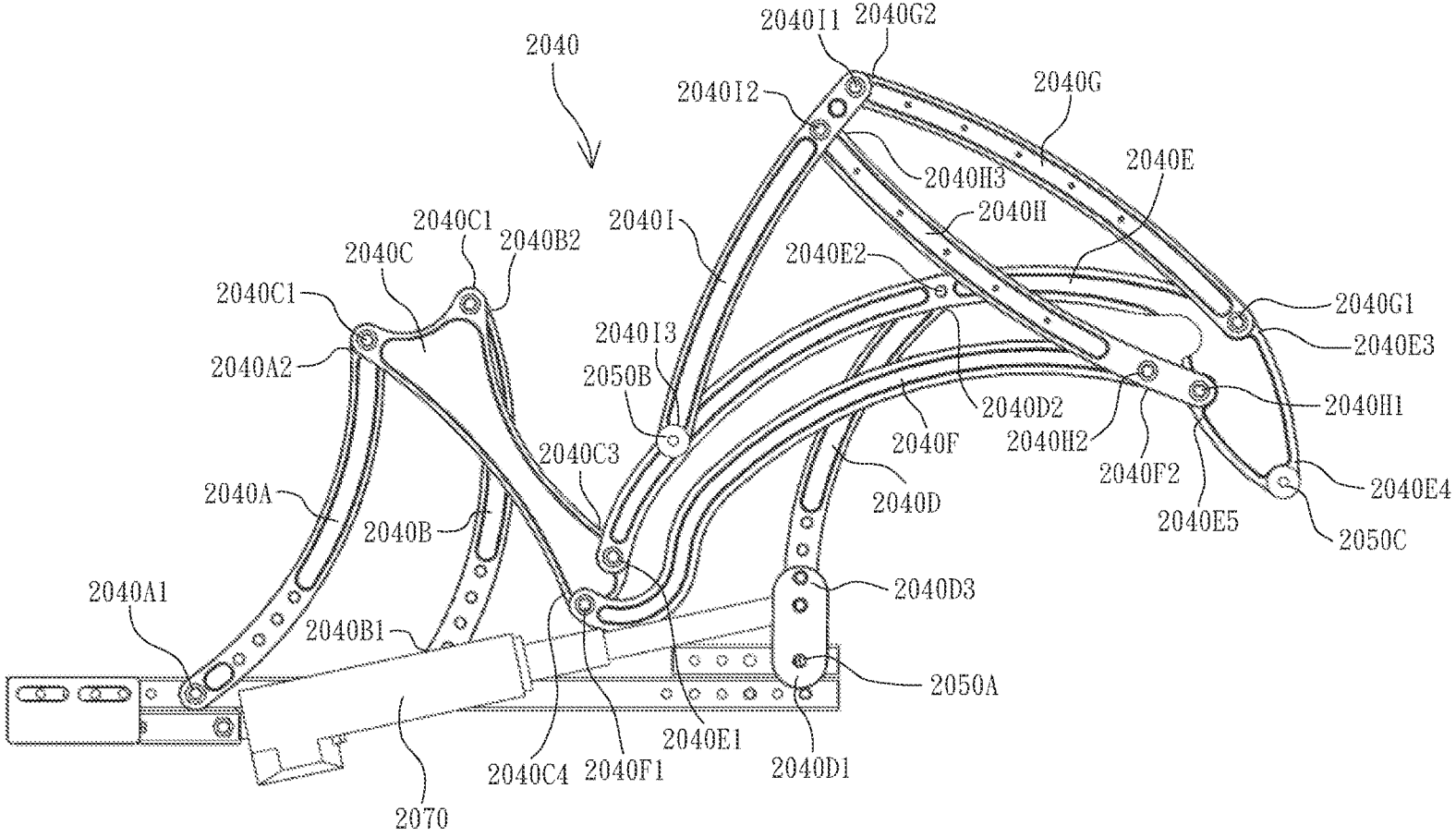
FIG. 13 is a side view of the semi-extracted linkage means according to an embodiment of the present invention.
Figure 14:
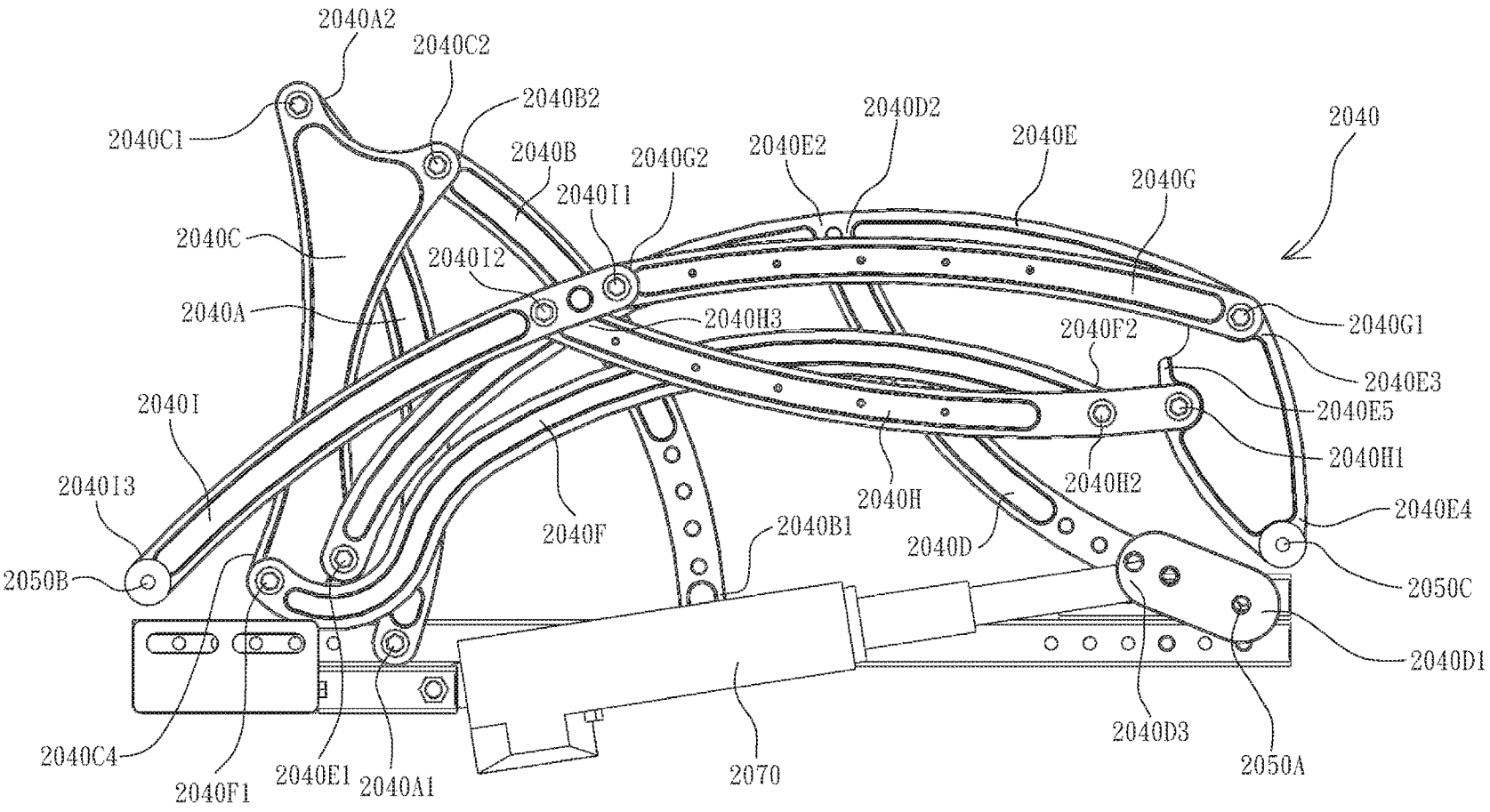
FIG. 14 is a side view of the retracted linkage means according to an embodiment of the present invention.
Figure 15:
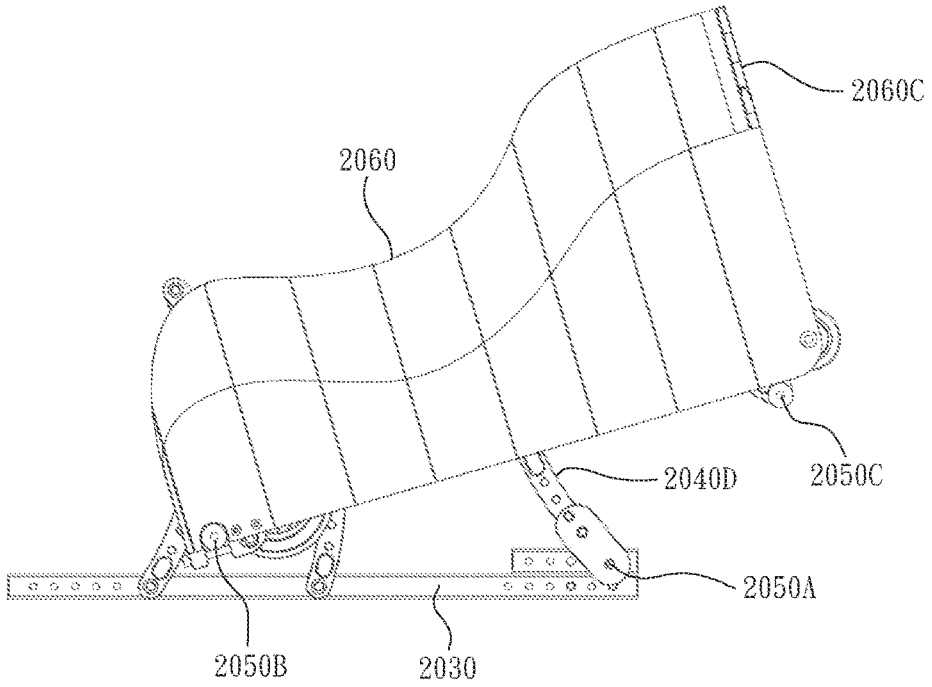
FIG. 15 is a diagram schematically showing a rack pivotally connecting to a pushing shaft and slidably connecting to a supporting shaft according to an embodiment of the present invention.

Refer to FIGS. 12-14, the linkage means 2040 includes a driving link 2040D, a first driven link 2040A, a second driven link 2040B, a third driven link 2040C, a supporting link 2040E, a transfer link 2040F, a forth driven link 2040G, a fifth driven link 2040H, and a pushing link 2040I. The driving link 2040D has a carriage end 2040D1, an opposite end 2040D2 and a driving end 2040D3 between the carriage end 2040D1 and the opposite end 2040D2. The first driven link 2040A has a carriage end 2040A1 and an opposite end 2040A2. The second driven link 2040B has a carriage end 2040B1 and an opposite end 2040B2. The third driven link 2040C has a first end 2040C1 pivotally connecting to the opposite end 2040A2 of the first driven link 2040A, a second end 2040C2 pivotally connecting to the opposite end 2040B2 of the second driven link 2040B, a third end 2040C3 and a forth end 2040C4 substantially at the opposite against the first end 2040C1 and second end 2040C2 of the third driven link 2040C. The supporting link 2040E has a first end 2040E1 pivotally connecting to the third end 2040C3 of the third driven link 2040C, a second end 2040E2 pivotally connecting to the opposite end 2040D2 of the driving link 2040D, a third end 2040E3, a forth end 2040E4 and a fifth end 2040E5 substantially at the opposite against the first end 2040E1 of the supporting link 2040E; where the second end 2040E2 of the supporting link 2040E is between the first end 2040E1 and third end 2040E3 of the supporting link 2040E. The transfer link 2040F has a first end 2040F1 pivotally connecting to the forth end 2040C4 of the third driven link 2040C and an opposite end 2040F2. The forth driven link 2040G has a first end 2040G1 pivotally connecting to the third end 2040E3 of the supporting link 2040E and an opposite end 2040G2. The fifth driven link 2040H has a first end 2040H1 pivotally connecting to the fifth end 2040E5 of the supporting link 2040E, a second end 2040H2 pivotally connecting to the opposite end 2040F2 of the transfer link 2040F, and an opposite end 2040H3, where the second end 2040H2 of the fifth driven link 2040H is between the first end 2040H1 and the opposite end 2040H3 of the fifth driven link 2040H. The pushing link 2040I has a first end 2040I1 pivotally connecting to the opposite end 2040G2 of the forth driven link 2040G, a second end 2040I2 pivotally connecting to the opposite end 2040H3 of the fifth driven link 2040H, and an carriage end 2040I3 pivotally connecting to a corresponding side of the rack in a predetermined path of motion when the driving link 2040D is pivoted, where the second end 2040I2 of the pushing link 2040I is between the first end 2040I1 and the carriage end 2040I3 of the pushing link 2040I.

Refer to FIG. 12, the carriage end 2040A1 of the first driven link 2040A and the carriage end 2040B1 of the second driven link 2040B are spaced apart on the carriage 2030 at a distance greater than that of the first end 2040C1 and the second end 2040C2 of the third driven link 2040C. The third end 2040C3 and the forth end 2040C4 of the third driven link 2040C are spaced apart at a distance substantially equally to that of the first end 2040H1 and the second end 2040H2 of the fifth driven link 2040H. The third end 2040E3 and the fifth end 2040E5 of the supporting link 2040E are spaced apart at a distance greater than that of the first end 2040I1 and the second end 2040I2 of the pushing link 2040I. When the driving link 2040D is pivoted about the carriage end 2040D1 of the driving link 2040D from the rear-most position, the carriage end 2040I3 of the pushing link 2040I starts to move substantially in an upward direction against the ground without any range of motion other then the upward and the downward directions; and then substantially in a forward direction of the vehicle; and substantially in a downward direction to the ground; and substantially in a forward direction of the vehicle, until the carriage end 2040I3 of the pushing link 2040I reaches a forwardmost position without any range of motion other than rearward direction of the vehicle.

Figure 11:
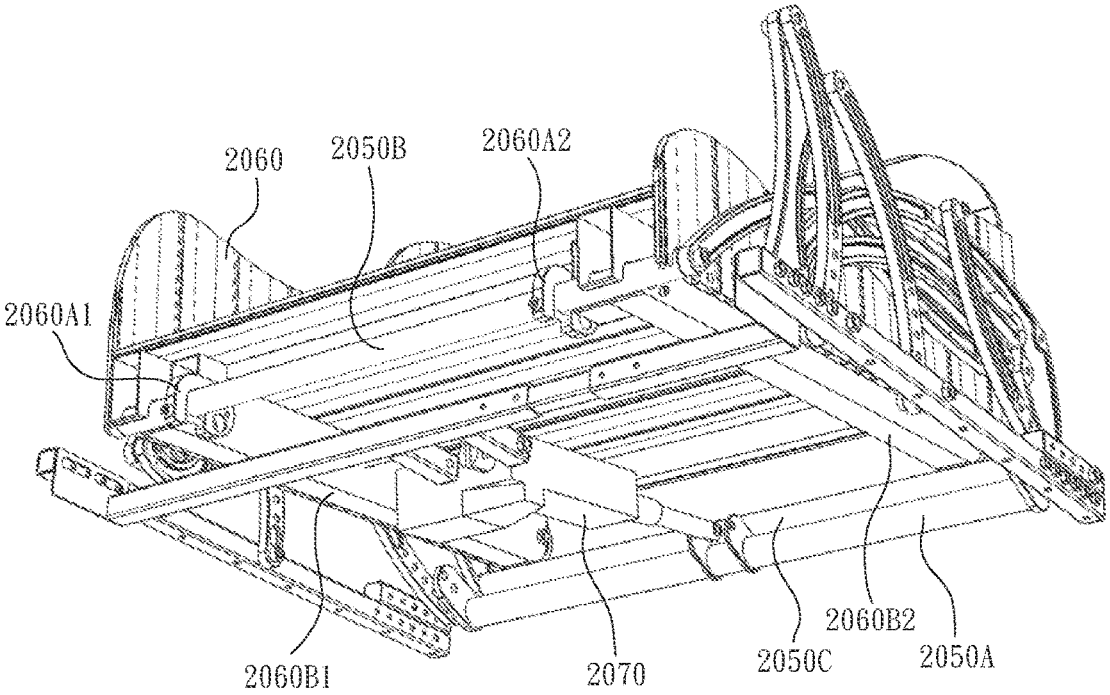
FIG. 11 is a diagram schematically showing a rack connector connecting a pushing shaft according to an embodiment of the present invention.

Refer to FIGS. 8-10, 12-14, the carriage end 2040D1 of the driving link 2040D has a driving shaft 2050A attached thereto whereby the driving link 2040D can be rotated by turning the driving shaft 2050A. The carriage end 2040I3 of the pushing link 2040I attaches to a pushing shaft 2050B. The forth end 2040E4 of the supporting link 2040E has a supporting shaft 2050C attached thereto. As shown in FIG. 11, a rack 2060 includes a rack sliding surface 2060B1, a rack opposite sliding surface 2060B2, a rack connector 2060A1 and a rack opposite connector 2060A2, wherein the rack connector 2060A1 and the rack opposite connector 2060A2 is used to connect the pushing shaft 2050B.

In the embodiment, a chassis 2010 is mounted to the lower surface of a vehicle rear compartment 1010. As shown in FIGS. 15-18, the rack 2060 is pivotally connected to the carriage 2030 through the pushing shaft 2050B driven by a set of links that further driven by a set of driving link 2040D connected to the driving shaft 2050A, and the rack 2060 further slides on the supporting shaft 2050C fixed on a supporting link 2040E. The rack 2060 has a support plate 2060C for at least one main wheel and at least one front wheel of the wheelchair, if the load is a wheelchair. A height adjustment means is provided on the chassis 2010 to compensate for variations in the height of the lower surface of the vehicle rear compartment 1010, and for variations in the surface of the ground.

Once the wheelchair is loaded, the rack and wheelchair are rotated substantially about the supporting shaft 2050C guiding the first axis of rack movement in the desired path of motion, and the rack sliding surface 2060B is slide on the Supporting shaft 2050C, guiding the second axis of rack movement in the desired path of motion. The translational and rotational motions are completed when the rack frame contacts a shock absorber mounted on the carriage. The rack is moved to a forward-most position so that the door of the rear compartment of the vehicle may be closed. The rotational portion of the loading cycle may be manually performed, but use of a reversible electric motor is preferable. The motor can be represent in either linear type, such as an electric cylinder, or rotational type, such as a worm gear which drives a spur gear attached to a shaft interconnecting the two driving links. Thus, power is transferred from the motor to the driving links, moving the rack and the wheelchair, which it carries. The motor is controlled by a cable-mounted or wireless remote control switch, which can be temporarily located outside the vehicle. The motor is further controlled by limit switches mounted in or adjacent to at least one of the links attached to the chassis. The switch is installed such that the frame of the rack or one of the links will strike a control button on the switch, which stops the motor during a loading cycle. A similar limit switch is utilized to stop the motor during an unloading cycle.

Figure 8A:
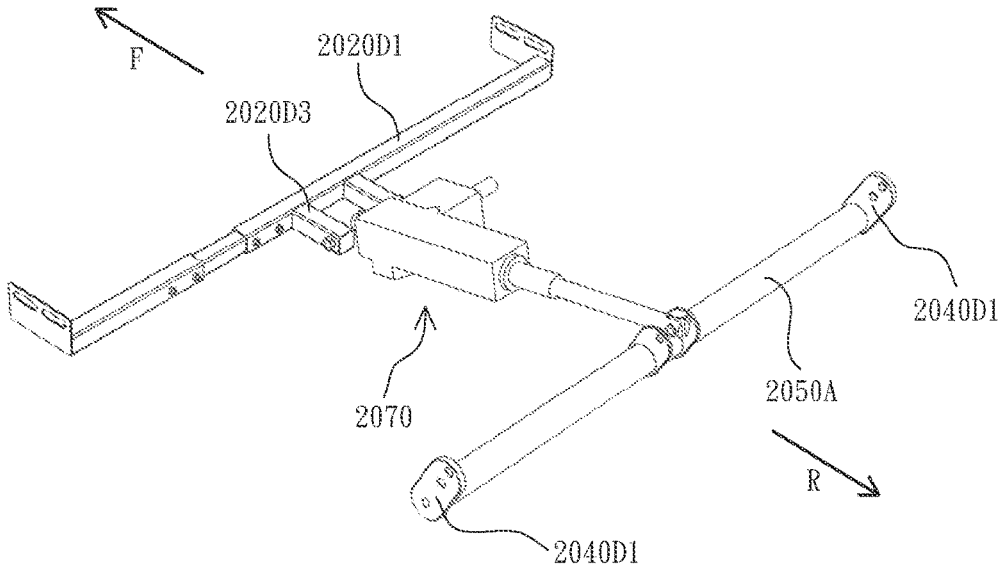
FIG. 8*a* is a diagram schematically showing an assembly of adaptor motor rod, electric actuator and driving shaft according to an embodiment of the present invention.
Figure 16:
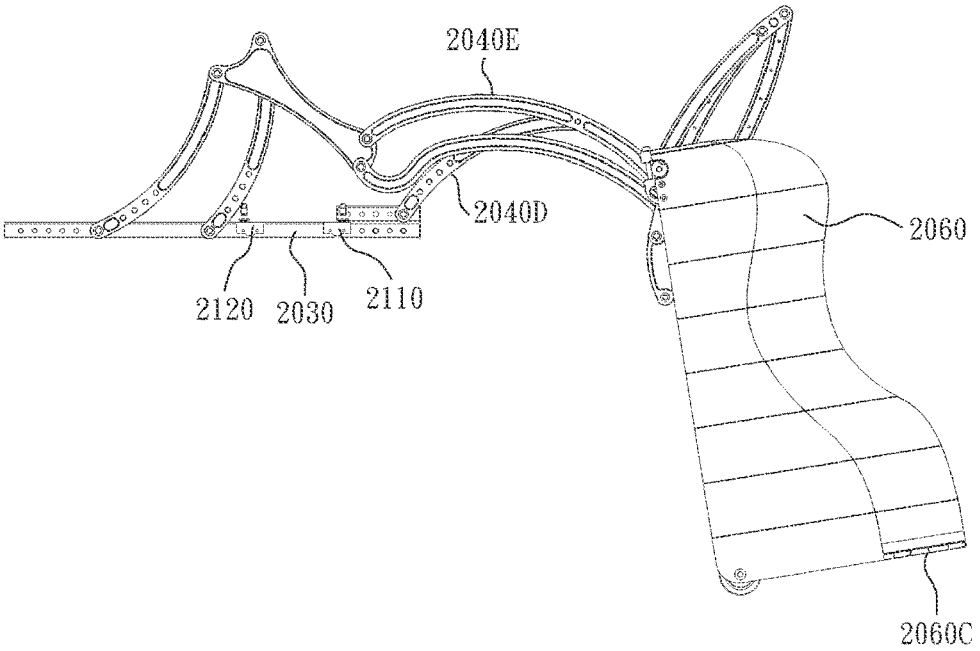
FIG. 16 is a side view of the linkage means and the rack in extracted state according to an embodiment of the present invention.
Figure 17:
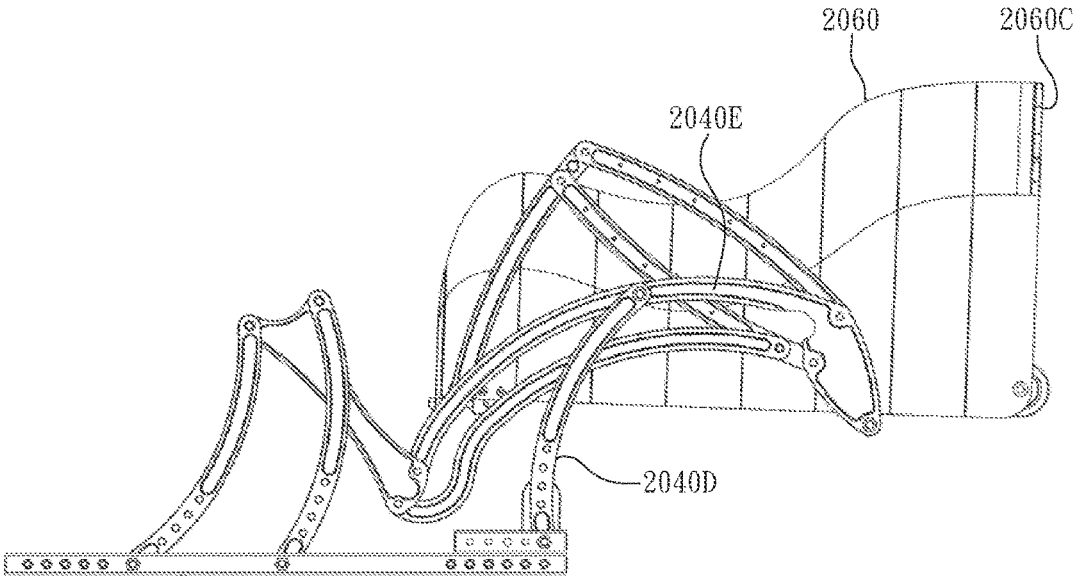
FIG. 17 is a side view of the linkage means and the rack in semi-extracted state according to an embodiment of the present invention.
Figure 18:
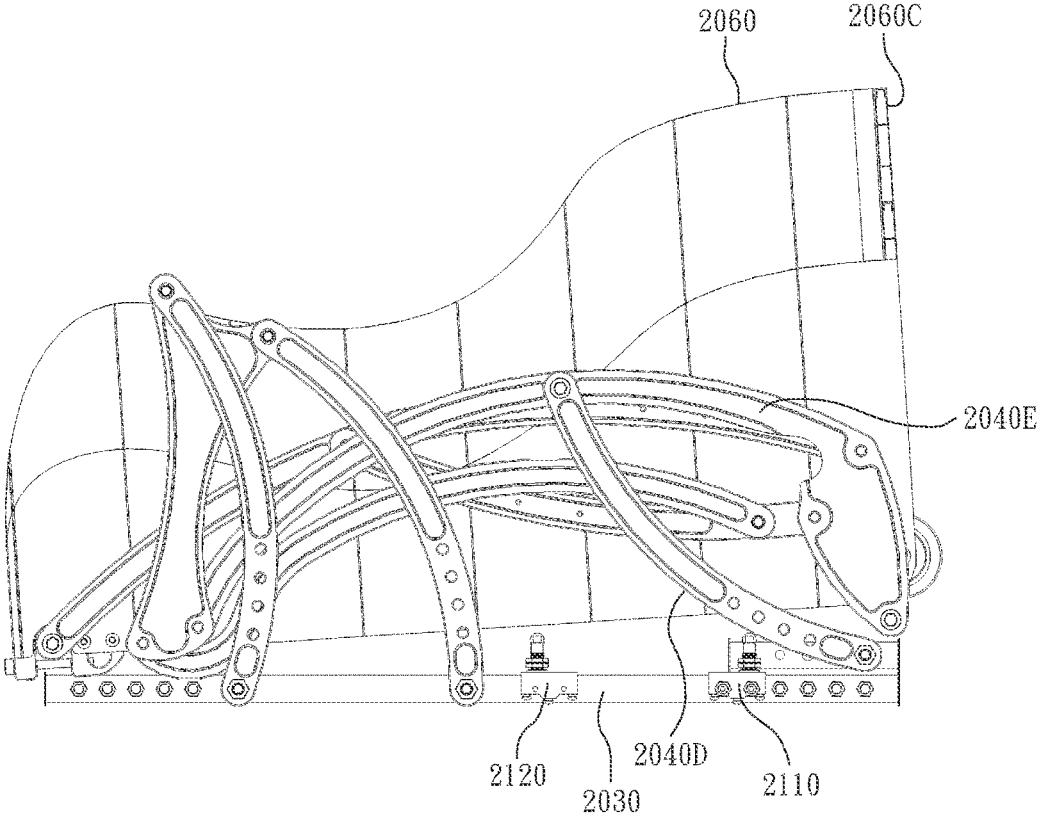
FIG. 18 is a side view of the linkage means and the rack in retracted state according to an embodiment of the present invention.

Refer to FIGS. **8*a*, 11-14, this loading transfer device 20 further includes: an electric actuator 2070, for example a motor, connecting the driving shaft 2050A and the adaptor motor base 2020D3, as shown in FIG. 8*a*. Further characterized as including: control switching means to start the motor for a loading and unloading cycle; and at least one limit switch to automatically stop the motor when the rack 2060 reaches the loading position or the storage position during the respective cycle. Refer to FIG. 1, the control switching means 2100 is mounted in a remote housing locatable outside of the vehicle and thus controllable by a person loading or unloading the wheelchair or other object. The control switching means 2100 connects with the motor via a wire or wirelessly. Refer to FIGS. 16 and 18, the at least one limit switch includes a first limit switch 2110 and a second limit switch 2120 configured on the carriage 2030. The first limit switch 2110 stops the motor when the first limit switch 2110 is contacted by a first link or a first portion of the rack 2060 when the rack 2060 is moved to the storage position. The second limit switch 2120 stops the motor when the second limit switch 2120 is contacted by a second link or a second portion of the rack 2060 when the rack 2060 is moved to the loading position. Here, the first link may be any one of the foregoing links, for example the links 2040A-2040I, which can contact the first limit switch 2110, when the rack 2060 is moved to the storage position. The second link may be any one of the foregoing links, for example the links 2040A-2040I, which can contact the second limit switch 2120, when the rack 2060 is moved to the loading position. The first/second portion of the rack 2060 may be any portion of the rack, which can contact the first/second limit switch, when the rack 2060** is moved to the storage/loading position.

Figure 8B:
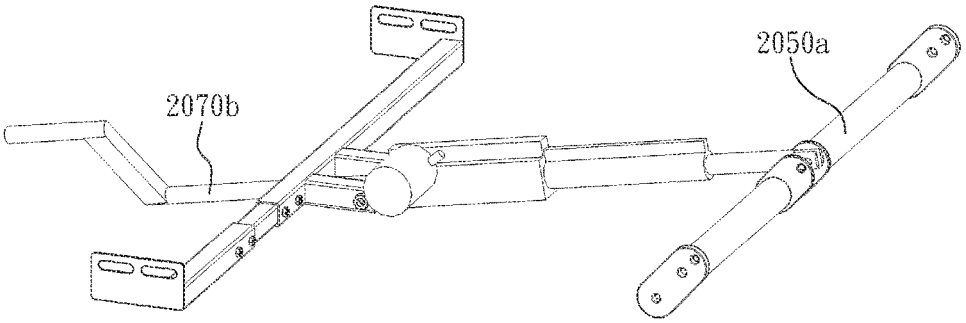
FIG. 8*b* is a diagram schematically showing an assembly of manual portion and driving shaft according to an embodiment of the present invention.
Figure 9:
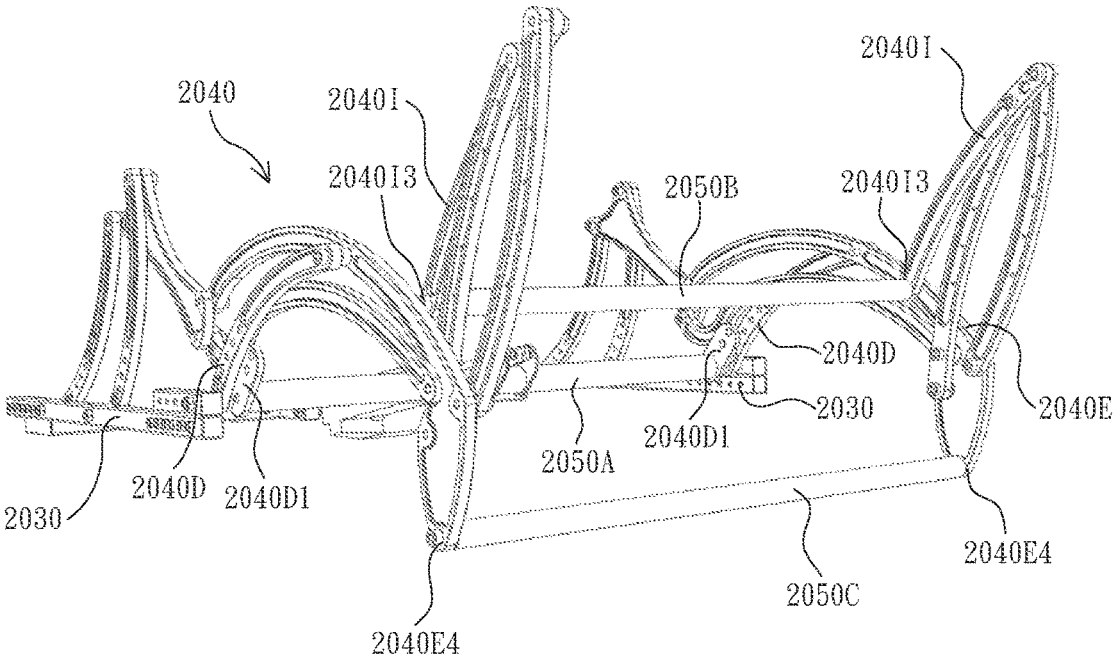
FIG. 9 is a diagram schematically showing an extracted state of the linkage means according to an embodiment of the present invention.
Figure 10:
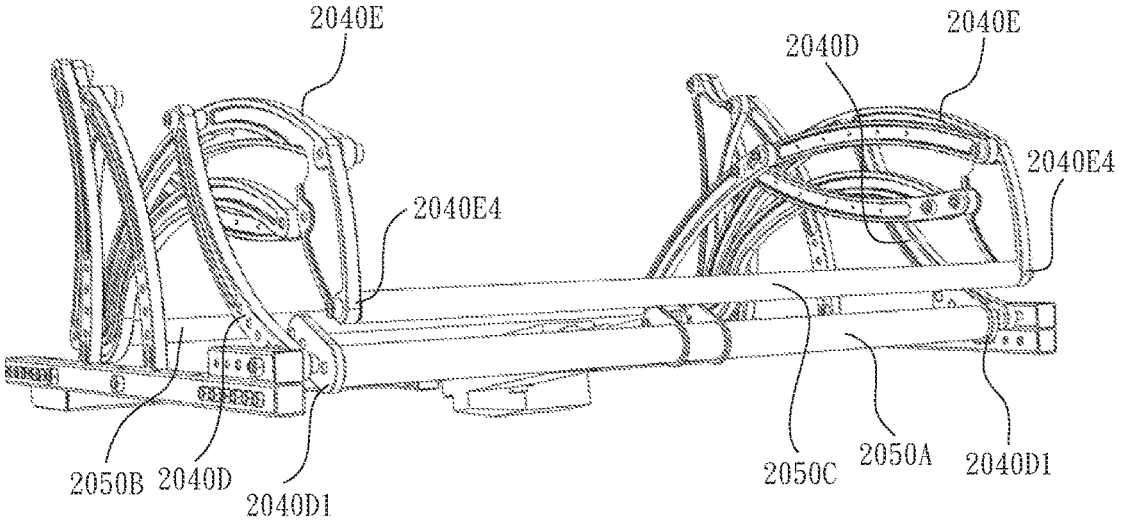
FIG. 10 is a diagram schematically showing a retracted state of the linkage means according to an embodiment of the present invention.

Refer to FIG. 8*b*, the motor may be replaced by a manual actuator, wherein a manual portion 2070*b* is operated to control the motion of the driving shaft 2050A. In another embodiment, the electric actuator and the manual actuator may both be configured on the loading transfer device, and user can choose to manually or electrically drive the loading transfer device.

Figure 19:
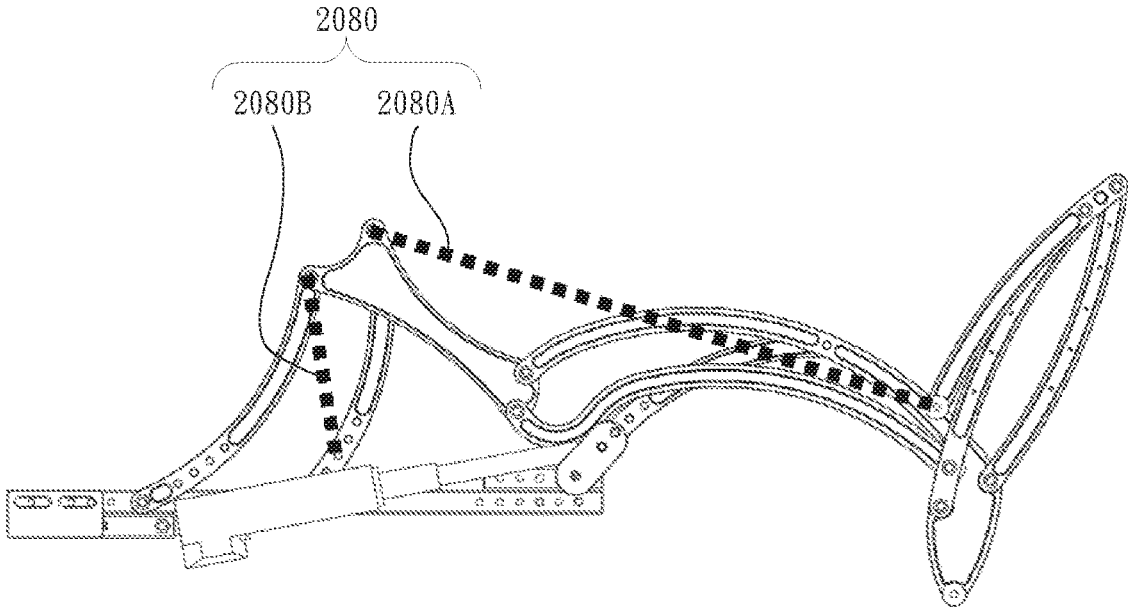
FIG. 19 is a side view of a counterbalance means applied to the loading transfer device according to an embodiment of the present invention.

In FIG. 19, the loading transfer device 20 further includes counterbalance means 2080, including either a first counterbalance means 2080A or a second counterbalance means 2080B or both, which are torsion or tension springs, for example, to counterbalance the rack 2060 when loaded to reduce the power required to move the loaded rack 2060 during a loading or unloading cycle. Wherein the plurality of springs connected to the linkage means 2040 and the carriage 2030, at least one of the springs causing a torque tending to rotate the linkage means 2040 from the loading position to the storage position and another of the springs causing a torque tending to rotate the linkage means 2040 from the storage position to the loading position.

Figure 20:
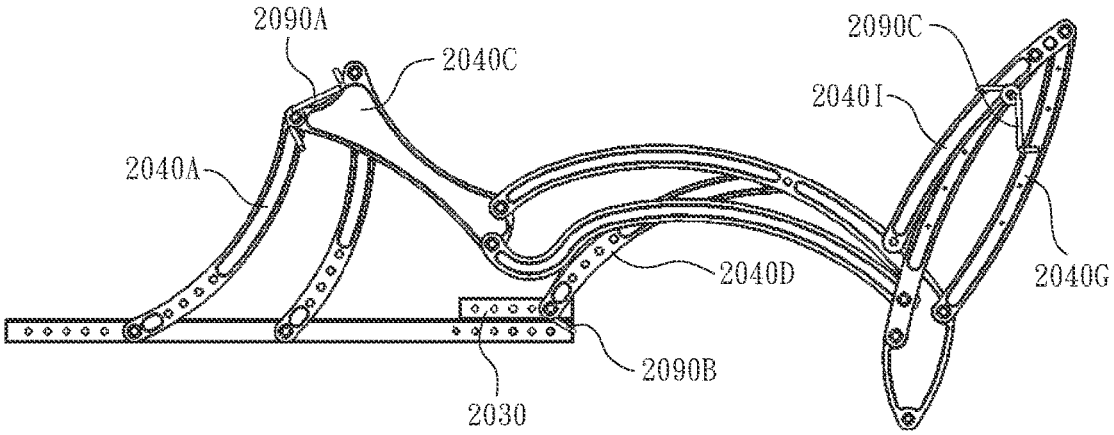
FIG. 20 is a diagram schematically showing examples on how one or more torsion springs can be installed in the linkage means.

FIG. 20 is a diagram schematically showing examples on how one or more torsion springs can be installed in the linkage means. (a) The spring can be installed between any two of links 2040A-2040I in the linkage means and coaxial with their pivot axis. As shown in FIG. 20, the spring 2090A is installed between the first driven link 2040A and the third driven link 2040C. (b) The spring can be installed between any one of links 2040A-2040I in the linkage means and the carriage 2030. As shown in FIG. 20, the spring 2090B is installed between the driving link 2040D and the carriage 2030. (c) The spring can be installed between any two of links 2040A-2040I in the linkage means and non-coaxial with their pivot axis. As shown in FIG. 20, the spring 2090C is installed between the forth driven link 2040G and the pushing link 2040I.

An optional set of springs mounted on a shaft interconnecting the links provide a means for counterbalancing the weight of the rack and chair, thereby reducing the power required by the motor to load or unload the loading transfer device.

It can be seen, therefore, that the loading transfer device of the present invention is well adapted to carry out the objects and obtain the ends and advantages mentioned, as well as those inherent therein. While one presently preferred embodiments of the invention have been described for the purposes of this disclosure, numerous changes in the construction and arrangement of parts can be made by those skilled in the art. All such changes are encompassed within the scope and spirit of this invention as defined by the appended claims.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A loading transfer device for loading a wheelchair or other object into a rear compartment of a vehicle, said loading transfer device comprising:

a carriage adapted for attachment to a lower surface of said rear compartment;

a rack to hold the wheelchair or other object; and rotatable linkage means pivotally connecting said rack to said carriage, whereby, as said linkage means is rotated in a continuous forward pivotal motion during a loading cycle, said rack and the wheelchair or other object held thereon are raised from a vertically oriented loading position at the rear of the vehicle in which said rack is adjacent a ground surface rearward of said vehicle to facilitate placement of the wheelchair or other object thereonto, forwardly pivoted through approximately 90°, passing through a point of maximum elevation, and lowered and moving forward simultaneously to a horizontal storage position in which said rack is adjacent and parallel to said carriage in said compartment, said cycle being reversible for unloading, wherein said linkage means comprises:

a driving link having a carriage end, an opposite end and a driving end between said carriage end and said opposite end;

a first driven link having a carriage end and an opposite end;

a second driven link having a carriage end and an opposite end;

a third driven link having a first end pivotally connecting to said opposite end of said first driven link, a second end pivotally connecting to said opposite end of said second driven link, a third end and a fourth end at an opposite end against said first end and second end of said third driven link;

a supporting link having a first end pivotally connecting to said third end of said third driven link, a second end pivotally connecting to said opposite end of said driving link; a third end, a fourth end and a fifth end at the opposite end against said first end of said supporting link; where said second end of said supporting link is between said first end and third end of said supporting link;

a transfer link having a first end pivotally connecting to said fourth end of said third driven link and an opposite end;

a fourth driven link having a first end pivotally connecting to said third end of said supporting link and an opposite end;

a fifth driven link having a first end pivotally connecting to said fifth end of said supporting link, a second end pivotally connecting to said opposite end of said transfer link, and an opposite end, where said second end of said fifth driven link is between said first end and said opposite end of said fifth driven link; and a pushing link having a first end pivotally connecting to said opposite end of said fourth driven link, a second end pivotally connecting to said opposite end of said fifth driven link, and a rack end pivotally connecting to a corresponding side of said rack in a predetermined path of motion when said driving link is pivoted, where said second end of said pushing link is between said first end and an opposite end of said pushing link;

wherein when said rack and said chair or other object are in said storage position, said carriage, said rack and said chair can be transported by said vehicle.

2. The loading transfer device according to claim 1, wherein said carriage further comprises:

a chassis having a surface to be in contact with said lower surface of said rear compartment, having a set of first chassis height connector and a set of second chassis height connector which is located at the forward side of said first chassis height connector on said chassis; and a height adaptor having a set of first adaptor height connector and a set of second adaptor height connector which is located at the forward side of said first adaptor height connector on said height adaptor, where said first adaptor height connector is coaxially connected to said first chassis height connector, said second adaptor height connector is coaxially connected to said second chassis height connector.

3. The loading transfer device according to claim 1, wherein:

said carriage ends of said first driven link and said second driven link are spaced apart on said carriage at a distance greater than that of said first end and said second end of third driven link;

said third end and said fourth end of said third driven link are spaced apart at a distance substantially equally to that of said first end and said second end of said fifth driven link;

said third end and said fifth end of said supporting link are spaced apart at a distance greater than that of said first end and said second end of said pushing link;

wherein when said driving link is pivoted about said carriage end of said driving link from the rear-most position, said carriage end of said pushing link starts to move in an upward direction against the ground without any range of motion other then said upward and said downward directions; and then in a forward direction of the vehicle;

in a downward direction to the ground; and in a forward direction of the vehicle, until said carriage end of said pushing link reaches a forwardmost position without any range of motion other than rearward direction of the vehicle.

4. The loading transfer device according to claim 1, wherein said carriage end of said driving link has a driving shaft attached thereto whereby said driving link can be rotated by turning said driving shaft.

5. The loading transfer device according to claim 4, wherein said height adaptor further comprise an adaptor width adjustor, a set of adaptor depth adjusting pairs, an adaptor motor rod, and an adaptor motor base, wherein said adaptor depth adjusting pair are respectively arranged on two opposite end of said adaptor width adjustor, said adaptor depth adjusting pair are respectively arranged on two opposite end of said motor rod, and said adaptor motor base is connected with said motor rod.

6. The loading transfer device according to claim 5, further comprising:

an electric or manual actuator connecting said motor base and said driving shaft, which is attached to said carriage end of said driving link, to rotate said linkage means and perform said loading and unloading cycles.

7. The loading transfer device according to claim 6, further characterized as comprising:

control switching means to start said motor for a loading and unloading cycle; and at least one limit switch to automatically stop said motor when said rack reaches said loading position or said storage position during the respective cycle.

8. The loading transfer device according to claim 7, wherein said control switching means is mounted in a remote housing locatable outside of said vehicle and thus controllable by a person loading or unloading said wheelchair or other object, wherein the control switching means connects with said motor via a wire or wirelessly.

9. The loading transfer device according to claim 7, wherein said at least one limit switch comprises:

a first limit switch to stop said motor when said first switch is contacted by a first link or a first portion of said rack when said rack is moved to said storage position; and a second limit switch to stop said motor when said second switch is contacted by a second link or a second portion of said rack when said rack is moved to said loading position.

10. The loading transfer device according to claim 1, further comprising counterbalance means to counterbalance said rack when loaded to reduce the power required to move said loaded rack during a loading or unloading cycle.

11. The loading transfer device according to claim 10, wherein said counterbalance means comprises at least one torsion or tension spring connected to said linkage means and said carriage.

12. The loading transfer device according to claim 10, wherein said counterbalance means comprises at least one torsion or tension spring connected to any two of said driving link, said first driven link, said second driven link, said third driven link, said supporting link, said transfer link, said fourth driven link, said fifth driven link, and said pushing link, and coaxial with their pivot axis.

13. The loading transfer device according to claim 10, wherein said counterbalance means comprises at least one torsion or tension spring connected to any two of said driving link, said first driven link, said second driven link, said third driven link, said supporting link, said transfer link, said fourth driven link, said fifth driven link, and said pushing link, and non-coaxial with their pivot axis.

* * * * *